United States Patent [19]

Abe et al.

[11] Patent Number: 4,977,881

[45] Date of Patent: Dec. 18, 1990

[54] AIR-FUEL RATIO CONTROL SYSTEM FOR AUTOMOTIVE ENGINE

[75] Inventors: Kunihiro Abe; Masanori Sakamoto, both of Tokyo, Japan

[73] Assignee: Fuji Jukogyo Kabushiki Kaisha, Tokyo, Japan

[21] Appl. No.: 466,763

[22] Filed: Jan. 18, 1990

[30] Foreign Application Priority Data

Jan. 19, 1989 [JP] Japan ..... 1-10680
Jan. 20, 1989 [JP] Japan ..... 1-12845

[51] Int. Cl.[5] ..... F02M 51/00

[52] U.S. Cl. ..... 123/489; 123/486; 123/480

[58] Field of Search ..... 123/489, 486, 440, 480

[56] References Cited

U.S. PATENT DOCUMENTS 4,905,653 3/1990 Manaka et al. ..... 123/480
4,907,555 3/1990 Manaka et al. ..... 123/489
4,913,122 4/1990 Uchida et al. ..... 123/489
4,924,836 5/1990 Uchida et al. ..... 123/440
4,924,837 5/1990 Chujo et al. ..... 123/440
4,928,654 5/1990 Hosaka ..... 123/486

*Primary Examiner*—Raymond A. Neill
*Attorney, Agent, or Firm*—Beveridge, DeGrandi & Weilacher

[57] ABSTRACT

There is disclosed an air-fuel ratio control system for an automotive engine having a fuel injection system including injectors, an intake air quantity measuring system including an intake air quantity sensor, and a canister purge control system corresponding to a necessity. The air-fuel ratio control system comprises a learning designation circuit for selecting a learning region for the measuring system or the injection system, a measuring system learning circuit for learning a correction amount of the measuring system responsive to the selection of the designation circuit, an injection system learning circuit for learning a correction amount of the injection system responsive to the selection, and a fuel quantity setting circuit for setting the quantity in dependency on an engine speed and an intake air quantity and for setting an actual fuel injection quantity by correcting the basic fuel injection quantity with the both correction amount.

5 Claims, 11 Drawing Sheets

AIR-FUEL RATIO CONTROL SYSTEM FOR AUTOMOTIVE ENGINE

BACKGROUND OF THE INVENTION

The present invention relates to an air-fuel ratio control system for an engine mounted on a vehicle and having a learning control function.

An electronic control fuel injection system generally determines an injection quantity $T_i$ by compensating a basic fuel injection quantity $T_p$ by various compensation factors.

The basic quantity $T_p$ is the injection quantity to obtain a theoretical air-fuel ratio and is calculated by the following equation (1) with a suction air quantity Q and an engine speed $S_E$:

$$T_p = K \times Q / S_E \quad (1)$$

where K is a constant.

The actual fuel injection quantity $T_i$ is set by multiplying the basic quantity $T_p$ by various correction coefficients corresponding to various operational conditions of the engine. The various correction coefficients include various increase correction coefficient COEF for adapting the air-fuel ratio to that of the operational condition by adding an acceleration correction coefficient, an air-fuel ratio feedback correction coefficient $\alpha$ for the theoretical air-fuel ratio, and a voltage correction coefficient $T_s$. The air-fuel ratio is controlled by the actual fuel injection quantity $T_i$ according to the following equation (2):

$$T_i = T_p \times \alpha COEF + T_s \quad (2)$$

In Order to keep the air-fuel ratio to the theoretical ratio, an air-fuel ratio sensor such as an oxygen sensor exposed in an exhaust pipe measures oxygen density of exhaust gases and a controller calculates an actual air-fuel ratio of the induced mixture. Air-fuel ratio feedback control is performed by the correction coefficient $\alpha$ in dependency on a difference between the calculated air-fuel ratio and the theoretical air-fuel ratio.

However, the air-fuel ratio feedback control requires a long time to converge the actual air-fuel ratio to a reference air-fuel ratio if the deviation between the reference ratio and the actual ratio is large. Furthermore, it is possible for the control of the air-fuel ratio to be disabled by instabilities such as overshoot or hunting of the air-fuel ratio when an engine operating condition rapidly changes or when the actual fuel injection quantity misses a control output in dependency on factors changing with the lapse of time.

Accordingly, more precise air-fuel control is realized by learning control having a learning value calculated by the difference between the actual air-fuel ratio and the reference ratio in order to improve the convergency of the feedback control, to compensate for deteriorations of individual parts or differences between the characteristics of each part, and to precisely correct the air-fuel ratio within the region in which air-fuel ratio feedback control cannot be performed. Namely, if a learning correction coefficient denotes $K_{BLRC}$, the fuel injection quantity $T_i$ is calculated by the following equation (3):

$$T_i = T_p \times \alpha \times COEF \times K_{BLRC} + T_s \quad (3)$$

and the air-fuel ratio is controlled by the fuel injection quantity $T_i$ corrected by learning.

Such air-fuel ratio control by learning is disclosed in Japanese Patent Laid-Open No. 61-72843 (1986). In the prior art, a plurality of learning values are respectively set corresponding to engine load. Each value has a common learning term commonly included in all operational regions of the engine, and some individual learning terms each corresponding to the operational region. After the values of the individual learning terms are respectively corrected in accordance with the air-fuel ratio feedback correction coefficient $\alpha$, the deviation is calculated between an average value of all individual learning terms and a reference value. Next, mutual correction is performed by subtracting the deviation from each individual learning term and by adding the deviation to the common learning term. In the technology shown in the prior art, a corrective range of the common learning term is set broader than a corrective range of the individual learning term.

Now, a cause influencing an air-fuel ratio, mainly includes two factors of a suction air quantity measurement system and a fuel injection system. In the measurement system, the actual air-fuel ratio deviates from the reference air-fuel ratio because of the deterioration of an intake air quantity sensor and the like, while the actual one deviates from the reference because of the deterioration of an injector, pressure regulator, and the like, in the injection system. Both deteriorations, of the measurement system and the injection system have different characteristics as shown in FIG. 9. Namely, the deviation of the air-fuel ratio by the deterioration of the injection system changes substantially in all alike according to the change of the intake air quantity Q. On the contrary, the deviation by the deterioration of the measurement system increases according to the increment of the intake air quantity Q. In the region of the intake air over the predetermined value, the deviated amount by the deterioration of the measurement system is greater than the amount by the injection system. Accordingly, the discrepancy of the detected intake air quantity to the actual quantity, which is caused by the deterioration of the intake air quantity sensor, is different from the discrepancy of the calculated fuel injection quantity to the actual injection quantity which is caused by the deterioration of the injector, pressure regulator because of the difference of the operational range and the deterioration characteristics. Therefore, in the learning control, the learning values vary in response to the change of the intake air quantities. As a result, it is problem that the controllability is deteriorated by setting the learning value by only single parameter such as the engine load.

On the other hand, the technology for performing the learning control by using two parameters, is disclosed in Japanese Patent Laid-Open No. 60-93150 (1985).

In the prior art, an air-fuel ratio is corrected not only during the air-fuel ratio feedback control but also in the region where the air-fuel ratio feedback control is not performed. A learning correction coefficient is stored in a three-dimensional map on a random access memory (RAM) in dependency on an operational condition of the engine such as the engine speed and the engine load. The air-fuel ratio is controlled by correcting the constant K in the equation (1) to calculate the basic fuel injection quantity $T_p$. The correction is achieved on the basis of the difference between the learning correction coefficient and an initial value only when predetermined number of the coefficients in the RAM are renewed over the predetermined times, and have the differences against the initial value in the same direction, respectively.

However, the map storing the learning correction coefficients requires a large memory capacity. Since the map has many regions which are not performed the learning, it is necessary to correct the learning value of the regions by presumption. Furthermore, since the fuel injection quantity is calculated by using the learning value corrected by the presumption, it is problem to lack precision at controlling the air-fuel ratio.

Still furthermore, as the above prior art has the construction that both deteriorations of the measurement and injection systems are learned together and stored in one map of the memory corresponding to the engine speed and the engine load, the prior art has a problem that it is impossible to individually detect each degree of the deteriorations of the measurement system and the injection system. Accordingly, it is impossible to correct the basic fuel injection quantity which is only influenced of deterioration of the measurement system by the aforementioned learning value, so that ignition timing control or the like using the basic fuel injection quantity as a controlling parameter receives a bad influence in the control precision.

On the other hand, in a vehicle having a canister purge system which adheres a vaporized fuel in a fuel tank to a canister for a time and returns the fuel to the engine during driving, the learning value changes corresponding to the change of the air-fuel ratio in dependency on the change of the purge quantity of the vaporized fuel. Therefore, the discrepancy of the learning value in each operational region reduces the control accuracy. Driving characteristics and exhaust emission of the vehicle deteriorate by the air-fuel ratio being too lean after the purge ends because it takes a long time to return the learning value to the value before the purge starts in accordance with the disappearance of the vaporized fuel adhered with the canister. Regarding this problem, applicants of this application disclose the technology of learning control by selectively using a learning table during the canister purge and a learning table at the time not to perform the purge, which is shown in Japanese Patent Laid-Open No. 61-1127 (1986), but there has not been disclosed a learning control in dependency on the difference of the deterioration characteristics between the measurement and the injection systems.

SUMMARY OF THE INVENTION

A primary object of the present invention is to provide an air-fuel ratio control system for an automotive engine, which has high accuracy of learning control based on both parameters of the measuring system and the injection system, respectively.

Other object of the present invention is to provide the air-fuel ratio control system capable of improving the control accuracy with decreasing the capacity of the memory storing the learning value by means of using the different learning tables each based on one different parameter.

Another object of the present invention is to improve the control accuracy without presumption learning by means of using the abovementioned different learning tables.

Furthermore, another object of the present invention is to provide the air-fuel ratio control system capable of properly calculating the basic fuel injection quantity in dependency on the correction by the learning value of the measuring system so as to improve other various control accuracy by use of the learning value. The system determines whether an operational region in which a discrepancy of an air-fuel ratio by a deterioration of characteristics of the measuring system occurs, or an operational region in which a discrepancy by a deterioration of the injection system occurs, in accordance with the operating condition of the engine, and performs the learning of the learning value table corresponding to the determined region.

Still furthermore, another object of the present invention is to provide the system capable of learning corresponding to each parameter of the measuring system or the injection system without the increment of the learning value capacity even if the vehicle has a canister purge system.

In order to achieve the aforementioned objects, an air-fuel ratio control system for an automotive engine, which has an engine speed sensor for detecting an engine speed, an air-fuel ratio sensor for detecting the condition of an air-fuel ratio of the engine, a fuel injection system with an injector for injecting fuel into a combustion chamber of the engine, and an intake air quantity measuring system including an intake air quantity sensor for detecting an intake air quantity, comprises designation circuit for designating a learning region corresponding to an engine operating condition by selecting one of a first learning region for the measuring system and a second learning region for the injection system; a first learning circuit responsive to a selection of the first learning region by the designation circuit for learning a first correction quantity in the measuring system from a discrepancy amount between a reference air-fuel ratio and an actual air-fuel ratio calculated in dependency on a signal output from said air-fuel ratio sensor; a second learning circuit responsive to a selection of the second learning region by the designation circuit for learning a second correction quantity in the injection system from the discrepancy amount; and a fuel injection quantity setting circuit for calculating a basic fuel injection quantity in dependency on the engine speed and for setting an actual fuel injection quantity with the first correction quantity learned by the first learning circuit and said second correction quantity learned by the second learning circuit.

By the above configuration, both learning regions of the measuring and the injection systems are properly selected corresponding to the engine operating condition. Furthermore, a discrepancy of the measuring system is corrected by the correction coefficient of the measuring system when the setting circuit sets the basic fuel injection quantity. Still furthermore, a discrepancy of the injection system is corrected by the correction coefficient of the injection system corresponding to the engine load also when the setting circuit sets the actual fuel injection quantity. As the basic fuel injection quantity and the fuel injection quantity are respectively corrected again, the air-fuel ratio of the engine is properly controlled.

Furthermore, it is possible to improve the learning accuracy and efficiency because the learning regions of the measuring system and the injection system do not overlap each other. Namely, the correction quantity of the injection system is learned in dependency on the discrepancy of the air-fuel ratio in the injection system learning value table constructed by the basic and the actual fuel injection quantities as parameters when the learning region is selected corresponding to open and close condition of the throttle valve, while the correction quantity of the measuring system is learned in the measuring system learning value table when the throttle valve is full closed.

DETAILED DESCRIPTION OF THE PREFERRED EMBODIMENTS

Figure 1:
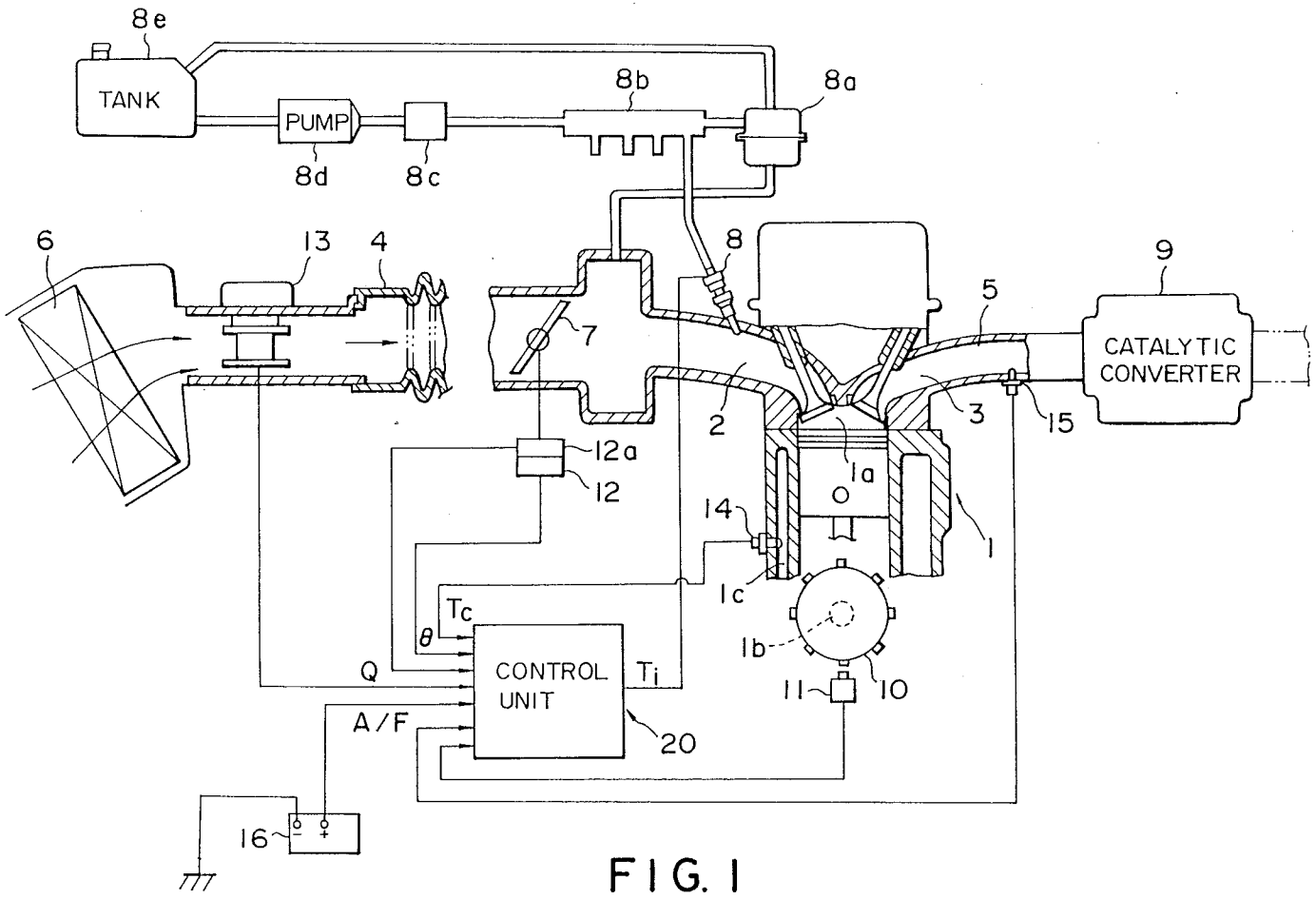
FIG. 1 is a schematic block diagram showing an engine control system with an air-fuel ratio control system according to a first embodiment of the present invention.

Referring to FIG. 1, an engine control system using an air-fuel ratio control system of a first embodiment is described. An engine 1 has a combustion chamber 1*a* and a crank shaft 1*b*. In each cylinder, the combustion chamber 1*a* communicates with an intake pipe 4 through an intake port 2, and communicates with an exhaust pipe 5 through an exhaust port 3. An air cleaner 6 is communicated with an upstream side of the intake pipe 4. The pipe 4 has a throttle valve 7 at an intermediate position thereof. An injector 8 is disposed in the upstream side of the intake port 2. The injector 8 is provided on each cylinder of the engine 1. A fuel injection system comprises the injector 8, a pressure regulator 8*a* for regulating a differential pressure between an air pressure in the pipe 4 and a fuel pressure, a delivery pipe 8*b* for supplying the fuel to the injector 8, a fuel filter 8*c* for filtering the fuel, a fuel pump 8*d* for feeding the fuel, and a fuel tank 8*e*. A catalytic converter 9 is provided in the exhaust pipe 5.

On the other hand, a crank rotor 10 is fixedly provided around the crank shaft 1*b*. A crank angle sensor 11 is provided against the outer surface of the rotor 10. A throttle position sensor 12 with an idling switch 12*a* is provided at the throttle valve 7 for detecting an opening degree of the throttle valve 7. The intake pipe 4 has an intake air quantity sensor 13 on the downstream side of the air cleaner 6. An intake air quantity measurement system including the sensor 13 and a control unit 20 calculates an intake air quantity. A fuel injection system having the injector 8, the fuel pump 8*d*, the pressure regulator 8*a* and the control unit 20 calculates a fuel quantity according to the intake air quantity. An air-fuel mixture is supplied through the intake port 2 to the combustion chamber 1*a* of the engine 1.

Furthermore, a coolant temperature sensor 14 is exposed in a coolant passage 1*c* formed in the engine 1. An air-fuel ratio sensor such as an oxygen sensor 15 is exposed in the exhaust pipe 5 at the upstream side of the catalytic converter 9.

A battery 16 supplies the engine control system with an electric power. The sensors 11 to 15 and the control unit 20 operate the system by stepped-down and stabilized voltage from the battery 16 through a constant voltage circuit (not shown).

Figure 2:
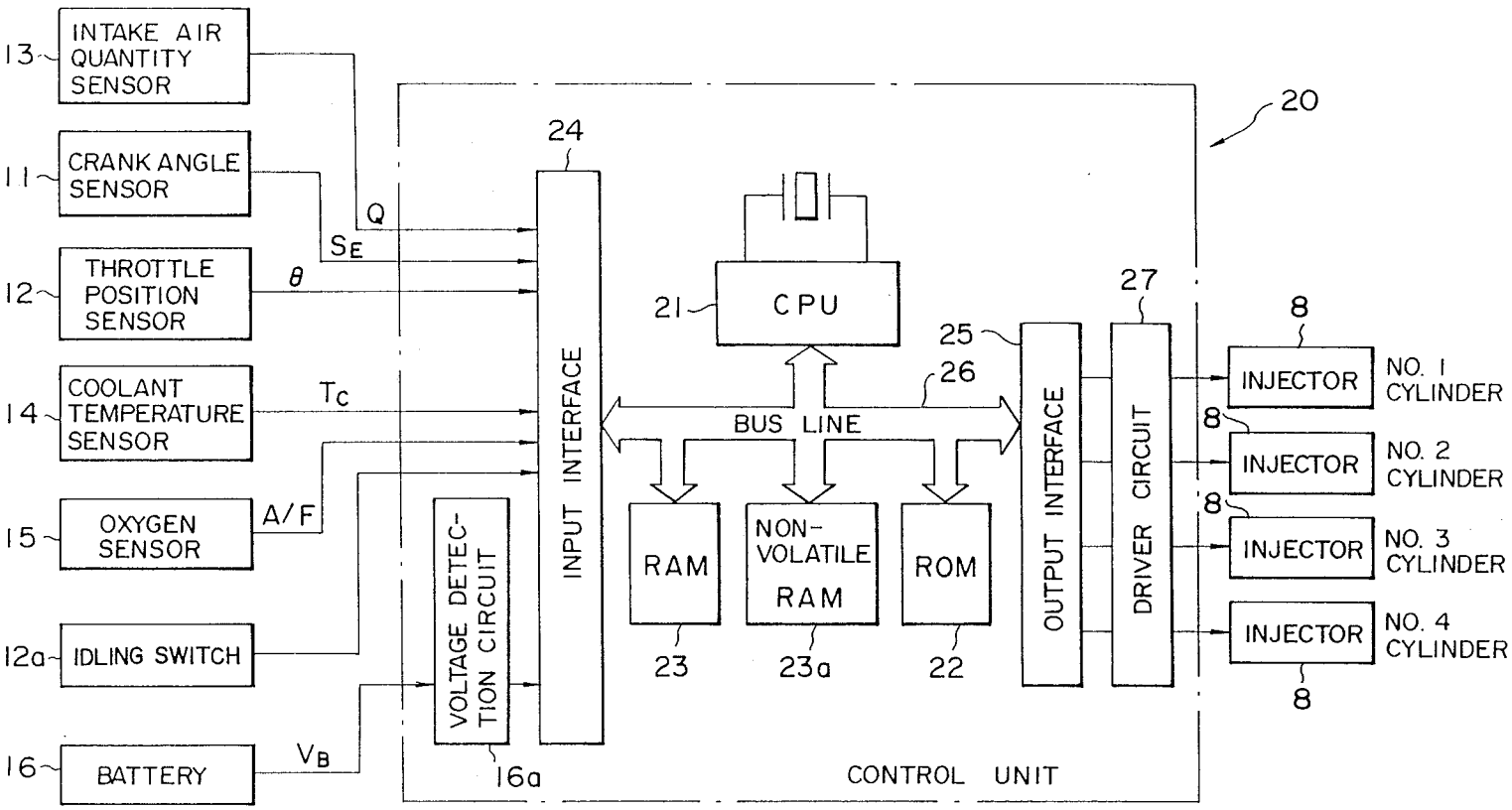
FIG. 2 is a block diagram showing the air-fuel ratio control system according to the first embodiment of the present invention.

An air-fuel control system is shown in FIG. 2. The control unit 20 comprises a central arithmetic processing unit (CPU) 21, a read only memory (ROM) 22, a random access memory (RAM) 23, a non-volatile RAM 23*a*, an input interface 24 and an output interface 25, which are interconnected each other by a bus line 26. The sensors 11 to 15 are connected to the input interface 24. The battery 16 is connected to the interface 24 through a voltage detection circuit 16*a*. The output interface 25 is connected to the injectors 8 provided on No. 1 to No. 4 cylinders, respectively, through a driver circuit 27.

The ROM 22 stores fixed data such as control programs, while the RAM 23 stores output values from several sensors 11 to 15 after processing data. The non-volatile RAM 23*a* stores a learning table $T_{QLR}$ of an intake air quantity measuring system and a learning table $T_{FLR}$ of a fuel injection system, which will be described later in detail. The non-volatile RAM 23*a* keeps the stored data by a backup of the battery 16 even though a starting switch for the engine is turned off.

The CPU 21 calculates an intake air quantity in dependency on an output signal from the intake air quantity sensor 13 according to the control program stored in the ROM 22. The CPU 21 further calculates a fuel injection quantity corresponding to various data stored in the RAM 23 and the non-volatile RAM 23*a*. At the same time, the CPU 21 calculates an injection timing and outputs an instruction via the driver circuit 27 to the injectors 8.

Next, the operation of the controller will be explained.

Figure 3:
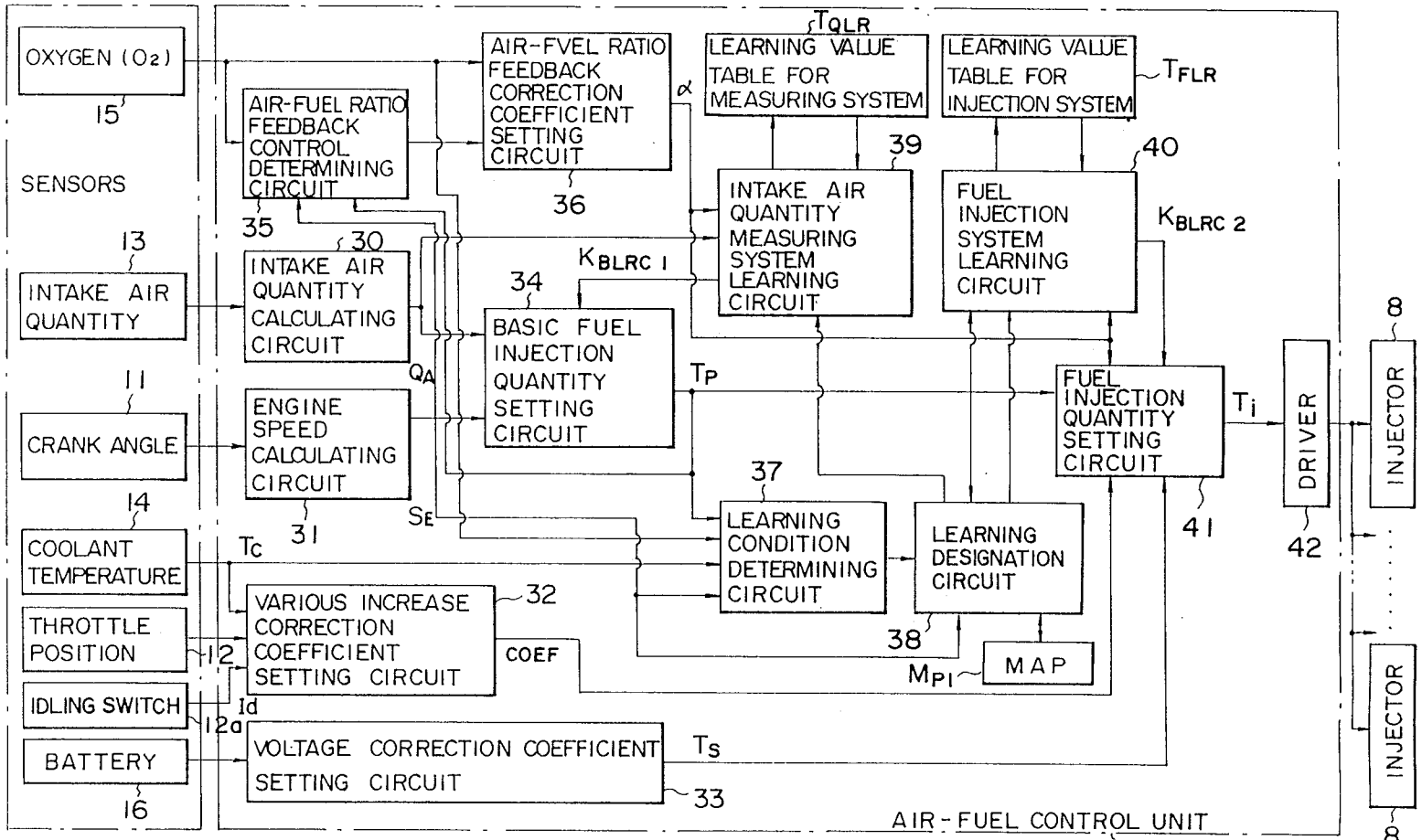
FIG. 3 is a block diagram showing a functional structure of the air-fuel ratio control system of the first embodiment.

As shown in FIG. 3, the air-fuel control unit 20 comprises an intake air quantity calculating circuit 30, an engine speed calculating circuit 31, a various increase correction coefficient setting circuit 32, a voltage coefficient setting circuit 33, a basic fuel injection quantity setting circuit 34, an air-fuel ratio feedback control determining circuit 35, and an air-fuel ratio feedback correction coefficient setting circuit 36. The unit 20 further comprises a learning condition determining circuit 37, a learning designation circuit 38, a learning designation map MP1, an intake air quantity measuring system learning circuit 39, a learning value table $T_{QLR}$ for the measuring system, a fuel injection system learning circuit 40, a learning value table $T_{FLR}$ for the injection system, a fuel injection quantity setting circuit 41, and a driver 42.

The intake air calculating circuit 30 calculates an intake air quantity $Q_A$ in dependency on a signal output from the intake air quantity sensor 13.

The engine speed calculating circuit 31 calculates an engine speed $S_E$ in dependency on a signal output from the crank angle sensor 11.

The various increase correction coefficient setting circuit 32 sets a various increase correction coefficient COEF such as a coolant temperature, an increase after idling, a throttle full opening increase and an acceleration/deceleration correction coefficients, in dependency on a coolant temperature signal $T_c$ from the coolant temperature sensor 14, an idling signal Id from the idling switch 12*a*, a throttle valve opening degree signal $\theta$ from the throttle position sensor 12.

The voltage correction coefficient setting circuit 33 reads out an invalid injection time (a pulse width) of the injectors 8 from a table (not shown) corresponding to a terminal voltage of the battery 16. The setting circuit 34 sets a voltage correction coefficient $T_s$ compensating the invalid injection time.

The basic fuel injection quantity setting circuit 34 calculates the basic fuel injection quantity $T_p$ in dependency on the intake air quantity $Q_A$ calculated by the circuit 30, the engine speed $S_E$ calculated by the circuit 31, and a learning correction coefficient $K_{BLRC1}$ for the intake air quantity measuring system, in accordance with the following equation (4):

$$T_p = K \times (Q_A/S_E) \times K_{BLRC1} \quad (4)$$

where a symbol K denotes a constant. The coefficient $K_{BLRC1}$ is calculated with interpolation after reference from the learning table $T_{QLR}$ for the measuring system by using the intake air quantity $Q_A$ as a parameter in the learning circuit 39.

Figure 6:
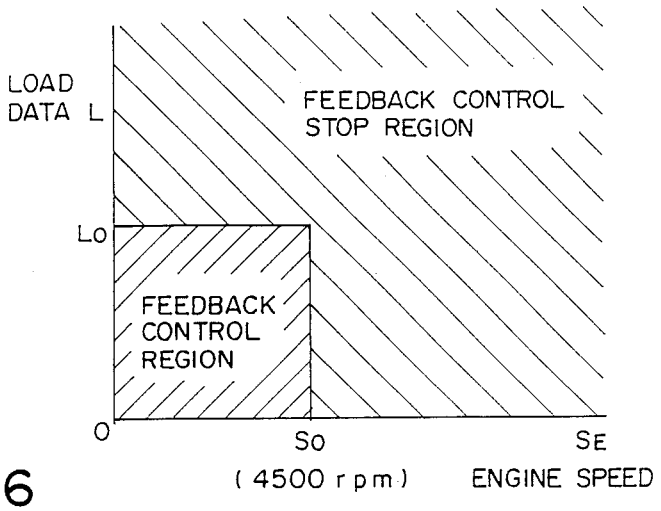
FIG. 6 is a conceptional diagram showing a feedback judgment map of the control system.

The air-fuel ratio feedback control determining circuit 35 reads the signal output from the oxygen sensor 15 and outputs a stop signal for stopping air-fuel ratio feedback control when the oxygen sensor 15 generates a detection value in an inactive region. Though the sensor 15 detects a value in an active region, the circuit 35 determines whether or not an air-fuel ratio feedback control condition is completed so as to instruct to the air-fuel ratio feedback correction coefficient setting circuit 36 whether or not the air-fuel ratio feedback control is performed. The determination as to whether the oxygen sensor 15 generates the detection value in the active region or not, is carried out as follows. For example, when the voltage difference between a maximum value $E_{MAX}$ and a minimum value $E_{MIN}$ of the oxygen sensor 15 during the predetermined time interval is less than a set value, the inactive condition of the oxygen sensor 15 is determined. On the contrary, when the voltage difference is on or over the set value, the active condition of the sensor 15 is determined. The determination for completing the air-fuel feedback control condition even if the sensor 15 is put in the active condition, is performed by a feedback determination map representing the engine speed $S_E$ and an engine load data $L_D$ in dependency on the basic fuel injection quantity $T_p$ as parameters, as shown in FIG. 6. By the map, the air-fuel ratio control stop signal is output to the correction coefficient setting circuit 36 when the engine speed $S_E$ is over a set speed $S_0$ (for example 4,500 r.p.m.) and the load $L_D$ is over a set load $L_0$, namely, where the engine operates in a throttle full opening region. When the engine speed $S_E$ and the load $L_D$ are under the respective set values, and the oxygen sensor 15 is in the active condition, the feedback control condition is completed so that the correction coefficient setting circuit 36 is instructed to start air-fuel feedback control.

The air-fuel ratio feedback correction coefficient setting circuit 36 generates an air-fuel ratio feedback control signal in dependency on the output signal from the oxygen sensor 15 when the feedback determining circuit 35 determine the start of the air-fuel ratio feedback control. The setting circuit 36 sets an air-fuel ratio feedback correction coefficient $\alpha$ corresponding to the control signal. Namely, the setting circuit 36 compares the output voltage of the oxygen sensor 15 with a slice level voltage and sets the coefficient $\alpha$ by means of proportion (P) and integral (I) control. The coefficient $\alpha$ is fixed "1" ($\alpha=1$) when the air-fuel ratio feedback control stops by determining the inactive condition of the oxygen sensor 15 or a full throttle condition.

The learning condition determining circuit 37 determines whether or not the engine is driven in the constant condition and a learning condition is completed by using a matrix being constructed by parameters of the engine load L corresponding to the basic fuel injection quantity $T_p$ set by the setting circuit 34 and the engine speed $S_E$ set by the calculating circuit 31, as shown in FIG. 7(*a*). The determining circuit 37 reads the voltage output from the oxygen sensor 15 and determines a division in the matrix in response to the engine speed $S_E$ and the engine load L. The circuit 37 determines the engine being constant condition when the voltage difference between the maximum value $E_{MAX}$ and the minimum value $E_{MIN}$ is on or over the set value $E_0$ such as 300 mV, that is, "$E_{MAX}-E_{MIN} \geqq E_0$", when the coolant temperature signal $T_C$ output from the sensor 14 is on or over the set value $T_{CO}$ such as 60° C., that is, "$T_C \geqq T_{CO}$", and when the engine operating condition in the same division of the matrix during the output voltage of the oxygen sensor 15 is turned over n times (such as four times) in the same division.

The learning designation circuit 38 determines whether the engine operating condition is in a learning value rewriting region (a learning region) for the fuel injection system or the intake air quantity measuring system when the determining circuit 37 determines the completion of the learning condition, in dependency on the load by the basic fuel injection quantity $T_p$ and the engine speed $S_E$ as parameters by using the learning designation map MP1 (see FIG. 7(*b*)) stored in the ROM 22. The designation circuit 38 instructs the fuel injection system learning circuit 40 to learn when the actual engine operating condition is in the learning value rewriting region for the fuel injection system, while the circuit 38 instructs the measuring system learning circuit 39 to learn when the operating condition is in the rewriting region for the measuring system.

The learning table $T_{QLR}$ for the measuring system is constructed on the non-volatile RAM 23*a* and has addresses $a_1$, $a_2$, $a_3$, . . . , an corresponding to intake air quantity ranges $Q_0Q_1$, $Q_1Q_2$, $Q_2Q_3$, . . . , $Q_{n-1}Q_n$, as shown in FIG. 7(*c*). The measuring system learning value $K_{QLR}$ is stored in every addresses $a_l$ to $a_n$ and has "$K_{QLR}=1.0$" as the stored initial value.

The learning circuit 39 for the measuring system obtains a deviation quantity between the reference value (ordinarily 1.0) and a mean value of the air-fuel ratio feedback correction coefficient $\alpha$ set by the setting circuit 36 in dependency on the learning instruction from the learning designation circuit 38. The measuring system learning value $K_{QLR}$ is rewritten by adding or subtracting the predetermined amount of the deviation quantity to or from the measuring system learning value $K_{QLR}$ stored in the corresponding address of the learning value table $T_{QLR}$ for the measuring system with the consideration of the plus or minus direction of the deviation quantity. Furthermore, the learning circuit 39 refers to the learning table $T_{QLR}$ for the measuring system and looks up the measuring system learning value $K_{QLR}$ by using the intake air quantity $Q_A$ as a parameter at the predetermined timing. The circuit 39 sets the learning correction coefficient $K_{BLRC1}$ for the measuring system by the interpolational calculation. As described above, the setting circuit 34 uses the coefficient $K_{BLRC1}$ for the calculation of the basic fuel injection quantity $T_p$, so that the error according to the deterioration of the measuring system is corrected.

The learning table $T_{FLR}$ for the injection system is COnstructed on the non-volatile RAM 23*a* separate from the table $T_{QLR}$ for the measuring system and has addresses $b_1, b_2, b_3, \ldots, b_n$ corresponding to basic fuel injection quantity ranges $T_{P0}T_{P1}$, $T_{P1}T_{P2}$, $T_{P2}T_{P3}, \ldots, T_{pn-l}T_{pn}$, as shown in FIG. 7(*d*). The injection system learning value KFLR is stored in every addresses $b_1$ to $b_n$ and has "$K_{FLR}=1.0$" as the stored initial value.

The learning circuit 40 for the injection system obtains a deviation quantity between the reference value and a mean value of the correction coefficient u in dependency on the learning instruction from the learning designation circuit 38. The injection system learning value $K_{FLR}$ is rewritten by adding or subtracting the predetermined amount of the deviation quantity to or from the injection system learning value $K_{FLR}$ stored in the corresponding address, which has a basic fuel injection quantity range corresponding to the specified division in the matrix when the circuit 37 determines the engine constant condition. Furthermore, the learning circuit 40 refers to the learning table $T_{FLR}$ for the injection system and looks up the injection system learning value $K_{FLR}$ by using the basic fuel injection quantity $T_p$ as a parameter at the predetermined timing. The circuit 40 sets the learning correction coefficient $K_{BLRC2}$ for the injection system by the interpolational calculation. The coefficient $K_{BLRC2}$ is used to calculate the actual fuel injection quantity, so that the error according to the deterioration of the injection system is corrected.

Namely, even if either the intake air quantity measuring system such as the intake air quantity sensor 13 or the injection system such as the injector 8 or pressure regulator 8*a* deteriorates, the discrepancy of the air-fuel ratio occurs as a result. Accordingly, it is possible to deteriorate controllability if those two learning values are learned in the same operating range of the engine. Namely, in the same range, the learning values are individually learned, so that since the deterioration characteristics are different from each other, one learning circuit learns the correction of a rich direction while the other learning circuit learns the correction of a lean direction. Furthermore, though the air-fuel ratio is kept to be the theoretical air-fuel ratio, the basic fuel injection quantity $T_p$ *has the discrepancy caused by the deterioration of the measuring system when the fuel injection quantity* $T_i$ is only corrected, so that other controls such as ignition timing control and the like using the basic fuel injection quantity $T_p$ as a parameter get out of order. Accordingly, if the engine operating range based on the engine speed $S_E$ and the engine load L (the basic fuel injection quantity $T_p$) is divided into the measuring system learning region and the injection system learning region, and if the learning correction for correcting the error of the intake air quantity $Q_A$ and the learning correction for correcting the injection quantity error of the actual fuel injection quantity $T_i$ are individually performed corresponding to the engine operating range, it is possible to improve accuracies of the basic and actual fuel injection quantities $T_p$ and $T_i$. Furthermore, it is possible to comparatively compact the memory region for learning.

Figure 9:
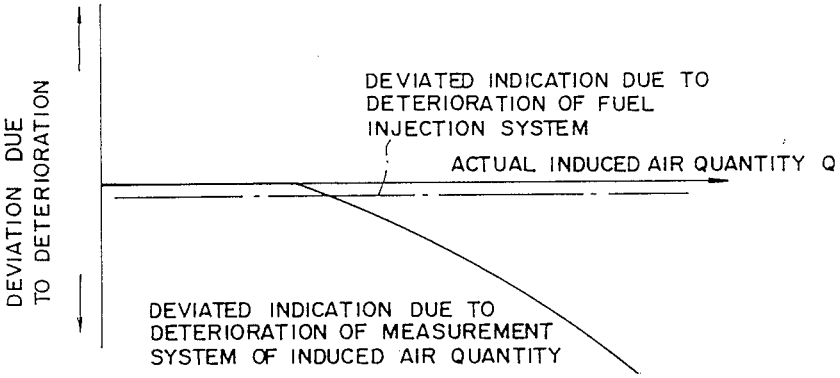
FIG. 9 is a characteristics diagram showing deterioration characteristics of the measuring system and the injection system.
Figure 7A:
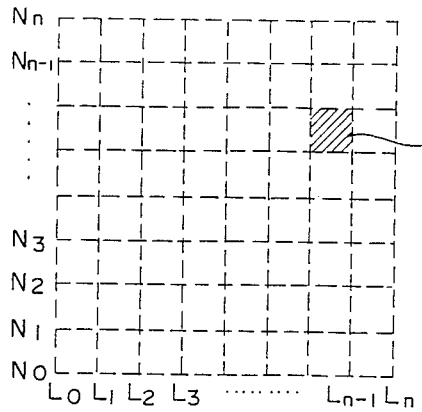
FIG. 7(*a*) to (*d*) are explanation views respectively showing matrix for the judgment of the constant condition, a learning setting map, and learning tables of an intake air quantity measuring system and a fuel injection system.
Figure 7B:
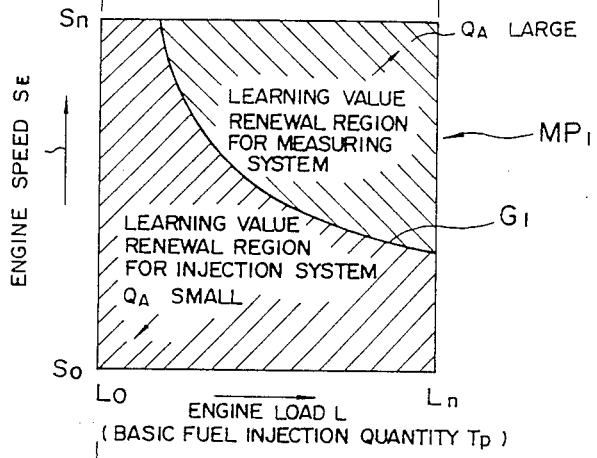
Figure 7C:
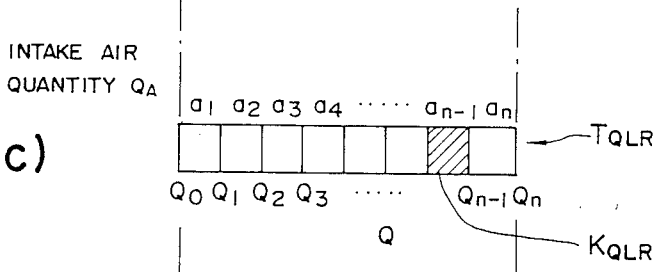
Figure 7D:
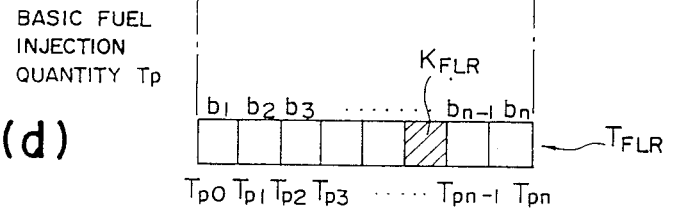

The deterioration of the intake air sensor 13 such as a hot typed air flow meter is due to sticking carbon on a hot wire. As shown in FIG. 9 showing the deteriorational characteristics, the larger the intake air quantity $Q_A$, the larger the difference of the air-fuel ratio in general.

On the other hand, the deterioration of the fuel injection system is, for example, (a) the change of the response time by mechanical wear of the injectors 8, (b) the reduction of the opening area of the injection nozzle by the accumulation of carbon, (c) the change of fuel pressure according to the change of the pressure receiving area caused by the deterioration of a diaphragm of the pressure regulator 8*a*, or (*d*) the decrease of fuel pressure caused by the deterioration of the fuel pump 8*d*. The deteriorational characteristics in the fuel injection system are substantially constant regardless the variation of the intake air quantity $Q_A$.

As Shown in FIG. 7(*b*), the operating range is divided into the learning regions of the learning circuits 39 and 40 for the measuring system and the injection system. A line G1 makes a border between both regions. Accordingly, it is possible to improve the learning accuracy in dependency on the smooth of the learning value distribution and the elimination of the inconstant learning value even if the learning frequencies are different from each other, by performing the learning correction in each of the divided learning regions. Furthermore, the error by the deterioration of the measuring system is corrected by the measuring system learning value $K_{BLRC1}$, while the error by the deterioration of the injection system is corrected by the injection system learning value $K_{BLRC2}$. As a result, every discrepancies between the theoretical air-fuel ratio as a reference ratio and the actual air-fuel ratio by the deteriorations of the measuring system and the injection system are eliminated, so that it is possible to extremely improve a controllability.

The setting circuit 41 sets the actual fuel injection quantity $T_i$ by correcting the basic fuel injection quantity $T_p$ in dependency on the various increase correction coefficient COEF, the voltage correction coefficient $T_S$, the air-fuel ratio feedback correction coefficient $\alpha$ and the injection system learning correction coefficient $K_{BLRC2}$ learned by the injection system learning circuit 40 according to the following equation (5):

$$T_i = T_p \times COEF \times \alpha \times K_{BLRC2} + T_S \quad (5)$$

The setting circuit 41 outputs a driving pulse signal corresponding to the actual fuel injection quantity $T_i$ at the predetermined timing to the injectors 8 through the driver circuit 42.

Next, there will be described an air-fuel ratio control procedure by the control unit 20 according to a flow chart shown in FIG. 4.

At first, in STEP S100, the outputs from the crank angle sensor 11 and the intake air quantity sensor 13 are read out, then the engine speed $S_E$ and the intake air quantity $Q_A$ are respectively calculated.

In STEP S101, the measuring system learning value $K_{QLR}$ is looked up from the measuring system learning table $T_{QLR}$ by using the intake air quantity $Q_A$ calculated in STEP S100 as a parameter and the correction coefficient $K_{BLRC1}$ for the measuring system is calculated by the interpolational calculation.

At STEP S102, the basic fuel injection quantity $T_p$ is calculated by the aforementioned equation (4) in dependency on the engine speed $S_E$ and the intake air quantity $Q_A$ respectively calculated in STEP S100, and the correction coefficient $K_{BLRC1}$ for the measuring system obtained in STEP S101, then operation continues to STEP S103.

At STEP S103, the unit 20 reads the coolant temperature signal $T_0$ from the sensor 14, the idling signal $I_d$ from the idling switch 12a, and the throttle valve opening degree signal $\theta$ from the throttle position sensor 12. Then, the various increase correction coefficient COEF such as the coolant temperature correction, the increase correction after idling, the throttle full opening increase correction, and the acceleration/deceleration correction is set in dependency on the signals $T_c$, $I_d$ and $\theta$ at STEP S104.

At STEP S105, a terminal voltage of the battery 16 is read out so as to set a voltage correction coefficient $T_s$ for compensating the injection invalid time of the injectors 8, then operation continues to STEP S106.

At STEP S106, after the voltage signal output from the oxygen sensor 15 is read out, the difference between the maximum voltage $E_{MAX}$ and the minimum voltage $E_{MIN}$ during the predetermined time interval is obtained. When the difference is on or over the set value, the oxygen sensor 15 is determined in the active condition, then operation continues to STEP S107. On the other hand, when the difference is less than the set value, the sensor 15 is determined to be in the inactive condition, then operation continues to STEP S109.

At STEP S107, the control unit 20 determines whether or not the air-fuel ratio feedback control condition is completed by using as parameters the engine speed $S_E$ calculated at STEP S100 and the engine load $L_D$ in dependency on the basic fuel injection quantity $T_p$ set at STEP S102. When the engine speed $S_E$ is less than the set speed $S_S$ (for example 4,500 r.p.m., namely $S_E<S_S$), and the load data $L_D$ is less than the set load $L_S$ (namely $L_D<L_S$), the unit 20 determines the condition to be completed and operation goes to STEP S108. On the other hand, when the engine speed is "$S_E \geqq S_S$" or the load data $L_D$ is "$L_D \geqq L_S$", namely, in the throttle substantially full throttle condition, the unit determines the condition to stop the air-fuel ratio feedback control and operation continues to STEP S109.

At STEP S109, the coefficient $\alpha$ is fixed to "$\alpha=1.0$", and air-fuel ratio feedback control stops. Then, operation goes to STEP S110.

Though the determination of the oxygen sensor to be activated is performed by comparison of the output signal with the set value, the determination of the activation may be performed in the manner that the coolant temperature signal $T_C$ supplied from the coolant temperature sensor 14 is compared with the set value, if the signal $T_C$ is less than the set value (the engine condition is cool), the oxygen sensor 15 is determined to be inactivate.

Furthermore, the determination for completing the control condition of the air-fuel ratio feedback at the STEP S107 may be performed by the determination of the full throttle condition in dependency on the throttle opening degree $\theta$.

At STEP S108, the output voltage from the oxygen sensor 15 is compared with the slice level so as to set the air-fuel ratio feedback correction coefficient $\alpha$ by proportional and integral control, and operation continues to STEP S110.

At STEP S110, the injection system learning value $K_{FLR}$ is looked up from the learning value table $T_{FLR}$ according to the intake air quantity $Q_A$ as a parameter calculated at STEP S102, then the learning correction coefficient $K_{BLRC2}$ for the injection system is calculated by the interpolation.

Next, at STEP S111, the actual fuel injection quantity $T_i$ is calculated by the equation (5) according to the basic fuel injection quantity $T_p$ set at STEP S102, the various increase correction coefficient COEF set at STEP S104, the voltage correction coefficient $T_S$ set at STEP S105, the air-fuel ratio feedback correction coefficient $\alpha$ set at STEP S108 or S109, and the learning correction coefficient $KB_{LRC2}$ calculated at STEP S110, then operation continues to STEP S112.

At STEP S112, the driving pulse signal corresponding to the actual fuel injection quantity $T_i$ is output to the injectors 8 through the driver circuit 42 in the predetermined timing.

Though corrective operation is performed at the aforementioned STEPs, the correction for the calculational error of the intake air quantity caused by the deterioration of the intake air sensor 13 may be performed by means of the direct correction for the intake air quantity $Q_A$ at the calculation of the intake air quantity $Q_A$ by the circuit 30 corresponding to STEP S100.

Next, rewriting a learning value renewal will be described according to a flow chart shown in FIG. 5.

At STEP S200, an output (namely, the voltage signal) from the oxygen sensor 15 is read out.

At STEP S201, the difference between the maximum voltage $E_{MAX}$ and the minimum voltage $E_{MIN}$ of the oxygen sensor 15 is compared with a set value $E_S$ such as 300 mV. When the difference is "$E_{MAX}-E_{MIN}<E_S$", the routine is finished, while in the case of "$E_{MAX}-E_{MIN} \geqq E_S$", operation continues to STEP S202.

At STEP S202, the unit 20 reads the coolant temperature signal $T_C$ from the coolant temperature sensor 14.

At STEP S203, the signal $T_C$ is compared with the set value $T_{CO}$ such as 60° C. In the case of "$T_C<T_{CO}$", routine ends. In the case of "$T_C \geqq T_{CO}$", operation continues to STEP S204.

Namely, in STEPs S201 and S203, the oxygen sensor 15 is determined to be in the active condition when there are "$E_{MAX}-E_{MIN} \geqq E_0$" and "$T_C \geqq T_{CO}$", and operation continues to STEP S204.

At STEP S204, the engine speed $S_E$ is calculated in dependency on a signal output from the crank angle sensor 11.

At STEP S205, the basic fuel injection quantity $T_p$ as a load L is calculated by the equation (4).

At STEP S206, the unit 20 determines whether or not the engine speed $S_E$ at STEP S204 and the load data L at STEP S205 are in the constant condition, respectively. Namely, the engine operating condition is determined whether or not within the region of the matrix of "$S_o \geqq S_E \geqq S_n$" and "$L_0 \leqq L \leqq L_n$", as shown in FIG. 7(*a*). When the speed $S_E$ and the load L are within the region of the matrix, the engine is determined to be in the learning value rewriting region, the divisional position in the matrix is specified to a division $D_1$ in the matrix as shown in FIG. 7(*a*). Then, operation continues to STEP S207. On the other hand, if both values are out of the matrix and the learning region, the routine of the unit 20 ends.

At STEP S207, the unit 20 determines whether the engine is in the constant condition or not by comparing the divisional position specified by the former routine with the present divisional position in the matrix. Namely, if both former and present positions are not same, the engine is determined to be inconstant and the learning value rewriting is not performed. Then, operation continues to STEP S208.

At STEP S208, the divisional position in the matrix specified by the present routine is stored in the RAM 23 as the former divisional position data for the next routine. Then, operation continues to STEP S209 in which a counter is cleared (COUNT←$\phi$) and the routine ends.

On the other hand, at STEP S210, if the present position is determined to be the same as the former position at STEP S207, the output voltage of the oxygen sensor 15 is read out, and the system determines whether the output voltage alternately changes the rich or lean side.

If the output voltage does not alternately change, the routine ends, while if the voltage alternately changes, the counter counts up its value at STEP S211.

At STEP S212, the routine is over when the counted value in the counter is less than n such as four, while the condition is determined as constant when the value is on or over n, then operation continues to STEP S213.

Namely, the learning value is renewed after the constant condition is determined at STEPs S207, S210 and S212, only when the load L and the engine speed $S_E$ are substantially constant and the voltage output from the oxygen sensor 15 turns n times.

Figure 8:
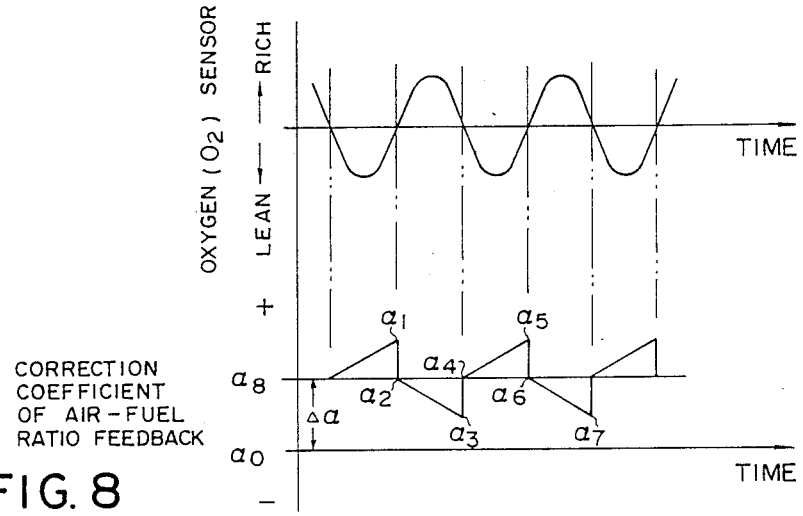
FIG. 8 is a characteristics diagram showing the relationship between a measured value of an oxygen sensor and a coefficient of a feedback correction of the air-fuel ratio.

As operation advances to STEP S213 after determination of constant condition, the counter is cleared. Then, at STEP S214, a mean value $\alpha$ is calculated from the correction coefficient for the feedback control while the counter counts times, and the system calculates a difference amount $\Delta\alpha$ between the mean value $\alpha$ and the reference value $\alpha 0$ such as "1.0" (refer to FIG. 8). Namely, the difference amount $\Delta\alpha$ is calculated by the following equation (6)

$$\Delta\alpha = \{(\alpha 1 + \alpha 5) + (\alpha 3 + \alpha 7)/4\} - \alpha 0 \quad (6)$$

where $\alpha 1$ and $\alpha 5$ represent a maximum value and $\alpha 3$ and $\alpha 7$ represent a minimum value, respectively, while the output voltage of the oxygen sensor 15 turns around four times. After the calculation, operation continues to STEP S215.

At STEP S215, the engine operating condition is specified in the learning value renewal region for either fuel injection system or intake air quantity measuring system from the learning designation map MP1 (refer to FIG. 7(*b*)) stored in the ROM 22 by using as parameters the engine speed $S_E$ and the load L (the basic fuel injection quantity $T_p$). If the engine operating condition ($S_E$, L) defined by the engine speed $S_E$ and the load L is on or over the line G1 of the map MP1, as shown in FIG. 7(*b*), namely "($S_E$, L)$\geqq$G1", the engine is determined to be driven in a high speed range with high load and operation advances to STEP S216 in dependency on the determination of the learning region for the measuring system.

At STEP S216, the learning value $K_{QLR}$ for the measuring system is derived from the corresponding address of the measuring system learning value table $T_{QLR}$ by using the intake air quantity $Q_A$ at the time as a parameter.

Then, at STEP S217, a new learning value $K_{QLR}$ is set in dependency on the learning value $K_{QLR}$ derived at STEP S216 and the difference amount $\Delta\alpha$ calculated at STEP S214 according to the following equation (7):

$$K_{QLR} + K_{QLR} + \Delta\alpha/M1 \quad (7)$$

where a coefficient M1 is the predetermined value set in the ROM 22 and is a constant (weighting average amount) for determining the ratio with the difference amount $\Delta\alpha$ in dependency on the deteriorational characteristics in the intake air measuring system at renewing the learning value. Then, the new learning value $K_{QLR}$ renews the corresponding address in the measuring system learning value table $T_{QLR}$.

On the other hand, when the engine operating condition ($S_E$, L) is determined to be less than the line G1 of the map MP1 shown in FIG. 7(*b*), namely "($S_E$, L) < G1", the engine is determined to be driven in a low speed range with low load at STEP S215 and operation continues to STEP S218 in dependency on the determination of the learning region for the injection system.

At STEP S218, the learning value $K_{FLR}$ for the injection system is derived from the corresponding address of the injection system learning value table $T_{FLR}$ by using the basic fuel injection quantity $T_p$ at the time as a parameter.

Then, STEP S219, a new learning value $K_{FLR}$ is set in dependency on the learning value $K_{FLR}$ derived at STEP S218 and the difference amount $\Delta\alpha$ calculated at STEP S214 according to the following equation (8):

$$K_{FLR} + K_{FLR}\Delta\alpha/M2 \quad (8)$$

where a coefficient M2 iS the predetermined value set in the ROM 22 and is a constant (weighting average amount) for determining the ratio with the difference amount $\Delta\alpha$ in dependency on the deteriorational characteristics in the injection system at renewing the learning value. Then, the new learning value $K_{FLR}$ renews the corresponding address in the injection system learning value table $T_{FLR}$.

Though, the aforementioned system according to the first embodiment uses the basic fuel injection quantity $T_p$ as the engine load L, the present invention may use, for example, the actual fuel injection quantity $T_i$ as the load data L in the place of the basic quantity $T_p$.

Furthermore, though the system of the first embodiment uses the learning values $K_{QLR}$ and $K_{FLR}$ having every initial values "1.0", which are respectively stored in the learning value tables $T_{QLR}$ and $T_{FLR}$ for the measuring system and the injection system, it is not necessary to be set "1.0" as the initial values. For example, both learning values $K_{QLR}$ and $T_{QLR}$ may be set to "0.0" as the initial values. In this case, the above equations (4) and (5) are respectively replaced to equations (9) and (10), $$T_p = K \times (Q_A/S_E) \times (l + K_{BLRC1}) \quad (9)$$

$$,ti\ T_i = T_p \times COEF \times \alpha \times (l + K_{BLRC2}) + T_S \quad (10)$$

Accordingly, the system of the first embodiment has two learning values $K_{QLR}$ and $K_{FLR}$ for the measuring system and for the injection system corresponding to the difference of the deteriorational characteristics between the measuring system and the injection system, and the values $K_{QLR}$ and $K_{FLR}$ are renewed in the individual learning regions according to every deteriorations of both systems, so that the overlapped corrections of the learning regions of both systems are eliminated, thereby improving the learning accuracy and controllability because both learning values do not conflict each other in the same learning region.

Next, there will be described an air-fuel ratio control system according to a second embodiment of the present invention with reference to FIGS. 10 to 13.

Figure 10:
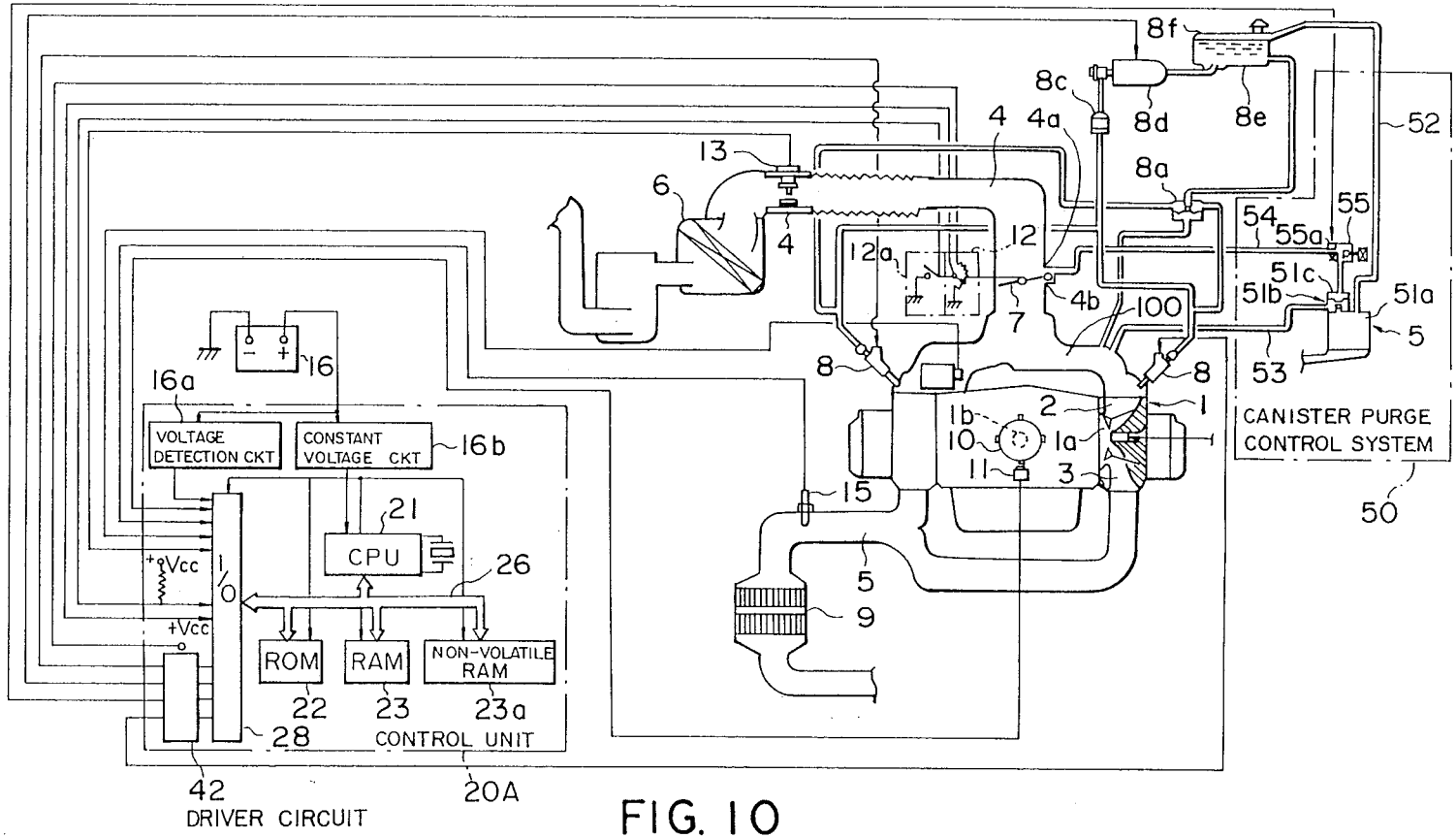
FIG. 10 is a schematic block diagram showing an engine control system with an air-fuel ratio control system according to a second embodiment of the present invention.

Referring to FIG. 10, there is described an engine control system using an air-fuel ratio control system according to the second embodiment of the present invention.

As an engine has a configuration equivalent to the first embodiment, same numerals as FIG. 1 represent the same or equivalent elements, thereby omitting the duplicational explanation.

The engine control system applied to the second embodiment has a canister purge control system 50 comprising a canister 51 with an adsorptive layer 51*a* for keeping the vaporized fuel in a fuel tank 8*e*, a path 52 for communicating an upper space 8*f* of the tank 8*e* with the canister 51, a purge line 53 for communicating the canister 51 with an intake manifold 100 through a purge valve 51*b* of the canister 51, a sensing line 54 for communicating a working chamber 51*c* of the purge valve 51*b* with ports 4*a* and 4*b* of the intake pipe 4 provided at immediately upstream and downstream portions of the full closed throttle valve 7, and a canister purge control valve 55 provided at an intermediate position of the sensing line 54.

The valve 55 including a coil 55*a* is operated to open and close by a control signal from a control unit 20A. When the valve 55 opens, a negative pressure corresponding to an opening degree of the throttle valve 7 is supplied to the working chamber 51*c* of the purge valve 51*b* so as to open the valve 51*b*. Then, a fuel vapor adsorbed to the adsorptive layer 51*a* is supplied to the intake manifold 100 corresponding to the negative pressure of the manifold 100. Namely, the above phenomenon is called as canister purge operation.

The control unit 20A, as shown in FIG. 10, is substantially same as the first embodiment shown in FIG. 2. The unit 20A comprises a voltage detection circuit 16*a*, a constant voltage circuit 16*b*, an input/output interface 28, and a driver circuit 42. Other parts are the same or equivalent as or to the control unit 20 shown in FIG. 2.

Next, referring to FIG. 11, there will be described a functional structure of the air-fuel control unit 20A. The control unit 20A comprises the same or equivalent circuits 30 to 42 and tables $T_{QLR}$ and $T_{FLR}$, a canister control valve driving circuit 46 for controlling the canister control valve 55 shown in FIG. 10, and a canister purge setting circuit 45 for setting canister purge operation as aforementioned in dependency on the coolant temperature signal $T_c$ and the idling signal $I_d$ output from the sensor 14 and the idling switch 12*a*, respectively.

Then, the functional constitution of the control unit 20A will now be described. The unit 20A comprises various calculating circuits 30 and 31, various setting circuits 32 to 34, 36 and 41, the determining circuit 37, the learning designation circuit 38, both system learning circuit 39 and 40, both learning value tables $T_{QLR}$ and $T_{FLR}$, which are the same or equivalent components as the first embodiment shown in FIG. 3. The unit 20A further comprises as new components the canister purge setting circuit 45 and the control valve driving circuit 46 for driving the canister control valve 55 of the system 50 shown in FIG. 10.

The canister purge setting circuit 45 reads signals respectively output from the idling switch 12*a* and the coolant temperature sensor 14 for setting the opening or closing of the canister purge control valve 55.

Namely, the circuit 45 outputs a purge cut signal to the driving circuit 46, when the coolant temperature $T_C$ is less than the set value $T_{C0}$ such as 60° C. ($T_C < T_{C0}$), or when the idling switch 12*a* is turned on, namely, the throttle valve 5 is in the full closing condition. On the other hand, the circuit 45 outputs a purge signal to the driving circuit 42*b*, when the temperature $T_C$ is on or over the set value $T_{C0}$ ($T_C \geqq T_{C0}$), and when the idle switch 12*a* is turned off.

The driving circuit 42*b* outputs an activating signal to the canister purge control valve 55 according to the signals output from the canister purge setting circuit 45. For instance, when the purge signal is output from the setting circuit 45, the coil 55*a* of the control valve 55 is not energized and the sensing line 54 is communicated to the working chamber 51*c* so as to open the purge valve 51*b* by negative pressure corresponding to the opening degree of the throttle valve 7, thereby purging the fuel vapor adsorbed to the adsorbate layer 51*a*.

On the other hand, when the purge cut signal is output, the coil 55*a* of the control valve 55 is energized to cut off the communication between the sensing line 54 and the working chamber 51*c*, thereby cutting off the purge of the vapor by shutting down the purge valve 51*b*.

Figure 11:
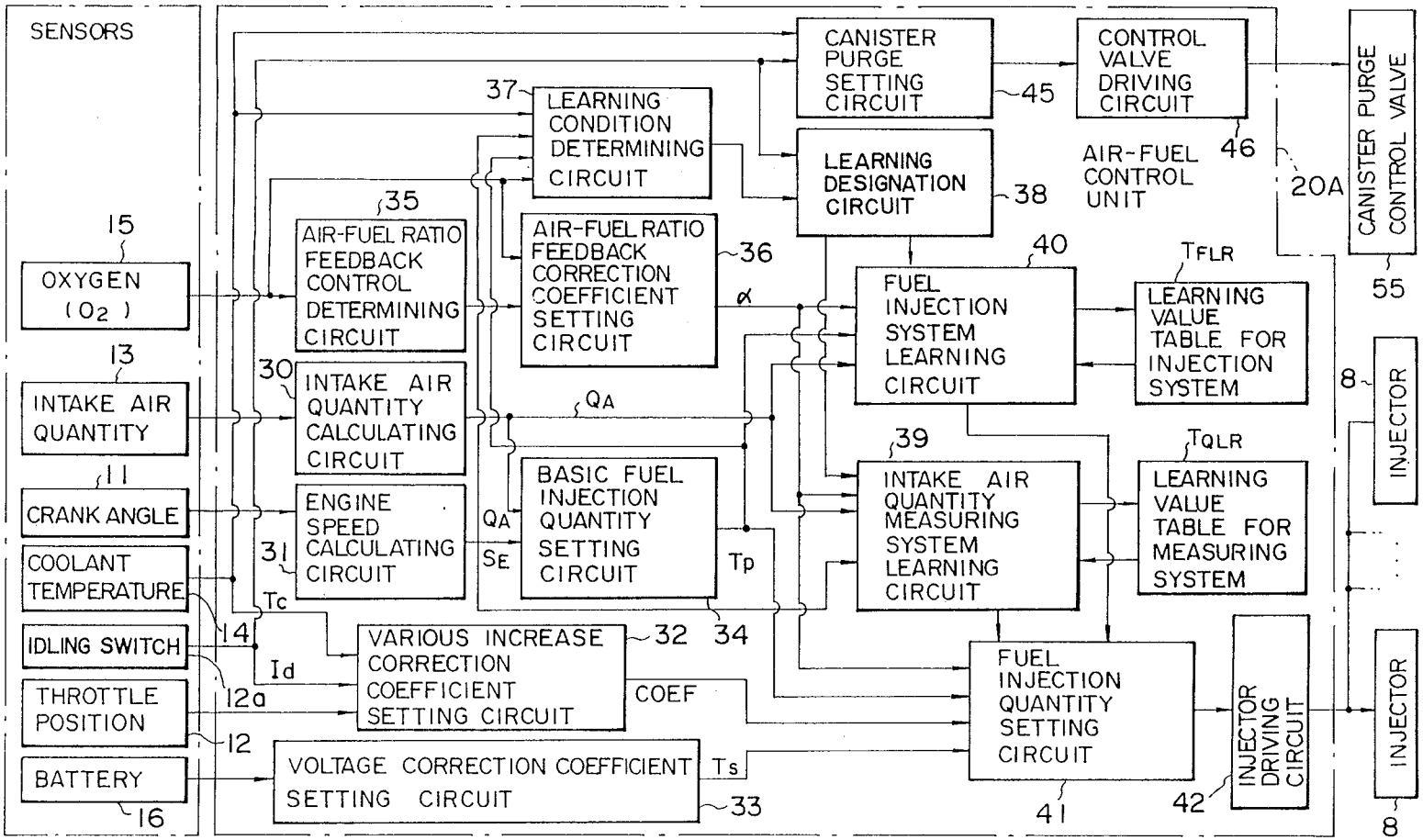
FIG. 11 is a block diagram showing the air-fuel ratio control system according to the second embodiment of the present invention.

Other circuits shown in FIG. 11 have the same or equivalent function as or to the first embodiment, thereby omitting the duplicational explanation except for operation of the learning condition determining circuit 37 and the designation circuit 38.

Namely, the learning of the measuring system is performed by the determining circuit 37 and the designation circuit 38 during the canister purge condition, for instance, when the idling switch 12*a* is turned off, and when the condition "$T_C \geqq T_{C0}$" is satisfied, while the learning of the injection system is performed during the purge cut condition, for instance, when the idling switch 12*a* is turned on. Accordingly, as the air-fuel ratio correction is performed by using the learning correction coefficients $K_{BLRC1}$ for the measuring system and $K_{BLRC2}$ for the injection system when the actual fuel injection quantity $T_i$ is calculated, it is possible to prevent the air-fuel ratio change at switching the conditions between the canister purge and purge cut each other.

Figure 12:
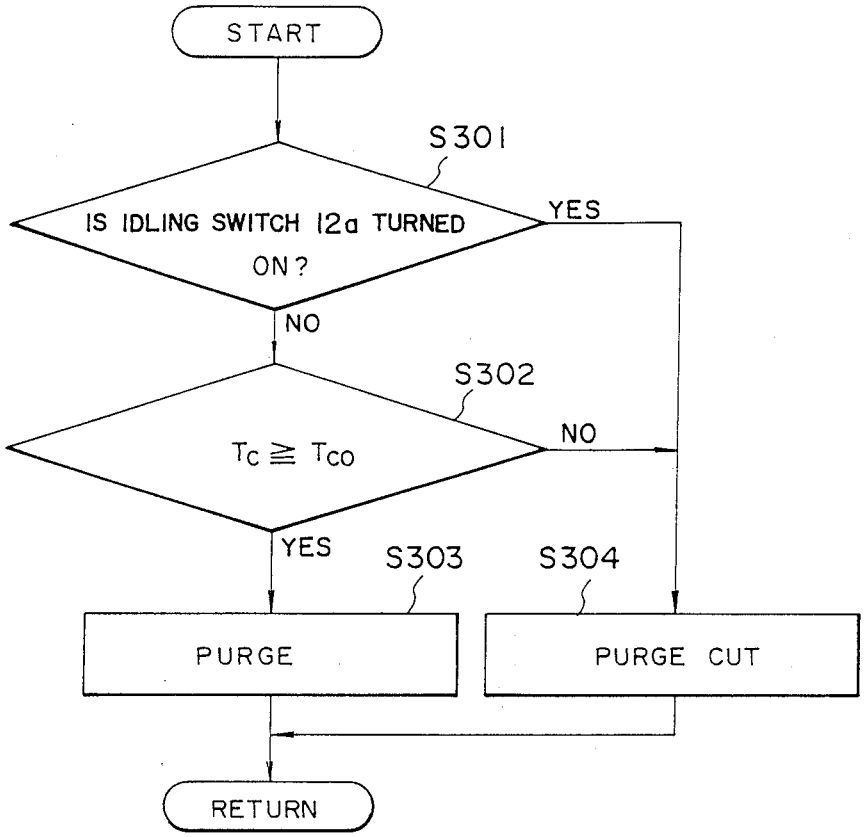
FIG. 12 is a flow chart showing a control procedure of a canister purge control valve.

There will now be described a control procedure for the canister purge control valve in reference with FIG. 12.

At STEP S301, the control unit 20A reads the signal output from the idle switch 12*a* and determines whether the switch 12a is turned on or off, namely, whether the throttle valve 12 is full closed or not. Then, operation continues to STEP S302 in the case of OFF, while to STEP S304 in the case of ON.

At STEP S302, the control unit 20A reads the coolant temperature signal $T_C$ from the sensor 14 and determines whether or not the signal $T_C$ is on or over the set value $T_{C0}$ such as 60° C.

If the condition "$T_C \geqq T_{C0}$" is satisfied, operation advances to STEP S303. At STEP S303, the coil 55a of the purge control valve 55 is not energized in dependency on the output of the purge signal, thereby communicating the sensing line 54 with the working chamber 51c so as to open the purge valve 51b to perform the purge.

On the other hand, if the idling switch 12a is turned on at STEP S301, or if the coolant temperature signal $T_C$ is in the condition "$T_C \geqq T_{C0}$", operation continues to STEP S304. At STEP S304, the purge setting circuit 45 outputs the purge cut signal for activating the coil 55a of the purge control valve 55, thereby cutting off the communication between the sensing line 54 and the working chamber 51c. By this interruption, the working chamber 51c opens to the atmosphere to cause the purge valve 51b to be closed for cutting off the purge.

Figure 13:
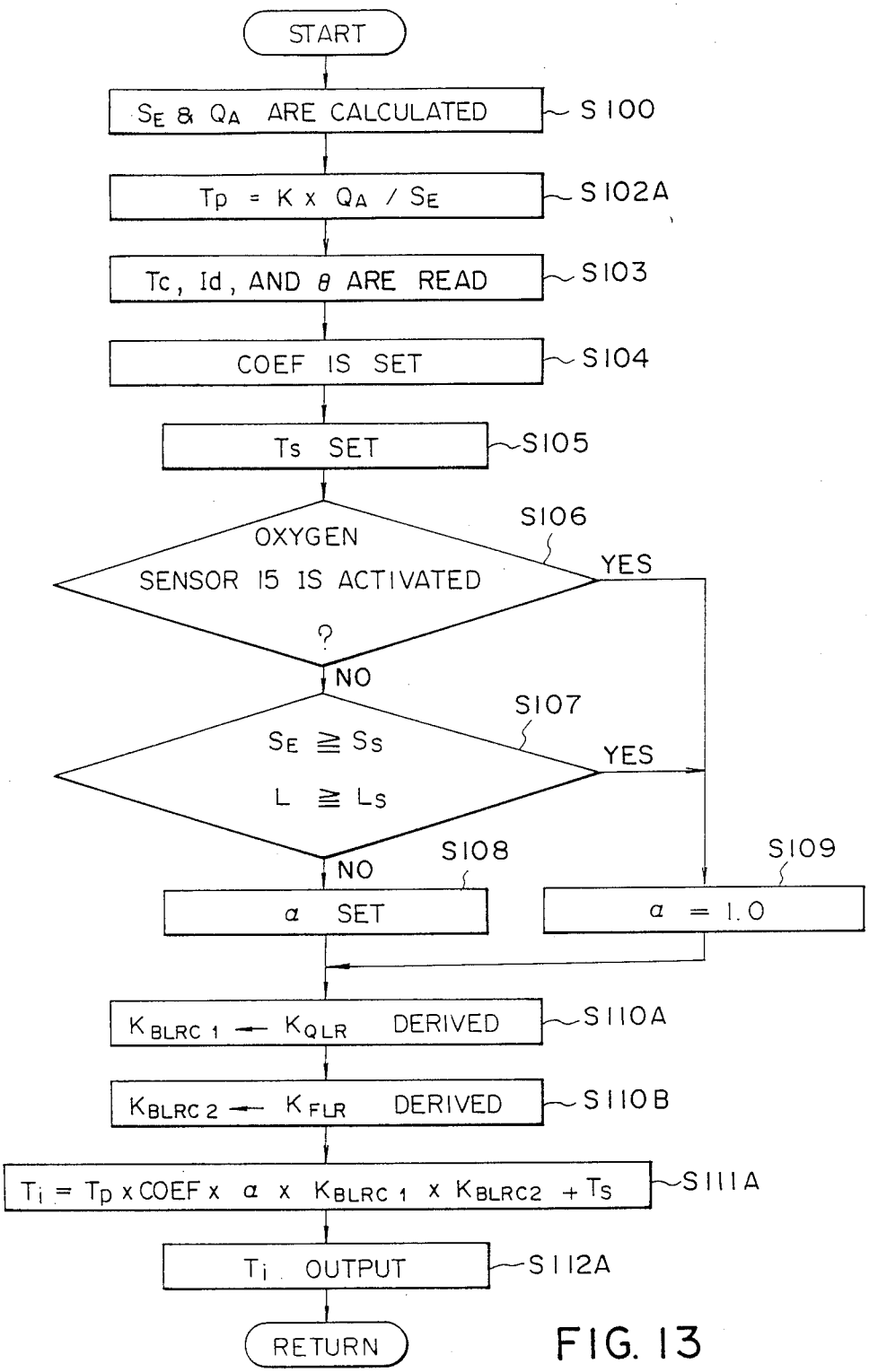
FIG. 13 is a flow chart showing a control procedure of the air-fuel ratio control system.

Next, there is described the control procedure of the air-fuel ratio control of the unit 20A according to the second embodiment of the present invention with reference to a flow chart shown in FIG. 13. As several STEPs of FIG. 13 represent the same or equivalent as or to those of FIG. 4, the procedure is schematically described.

At STEP S100, the engine speed $S_E$ and the intake air quantity are respectively calculated.

At STEP S102A, the basic fuel injection quantity $T_p$ is calculated by the following equation (11):

$$T_p = K \times S_E / Q_A \quad (11),$$

where K is a constant, and operation continues to STEP S103.

Figure 4:
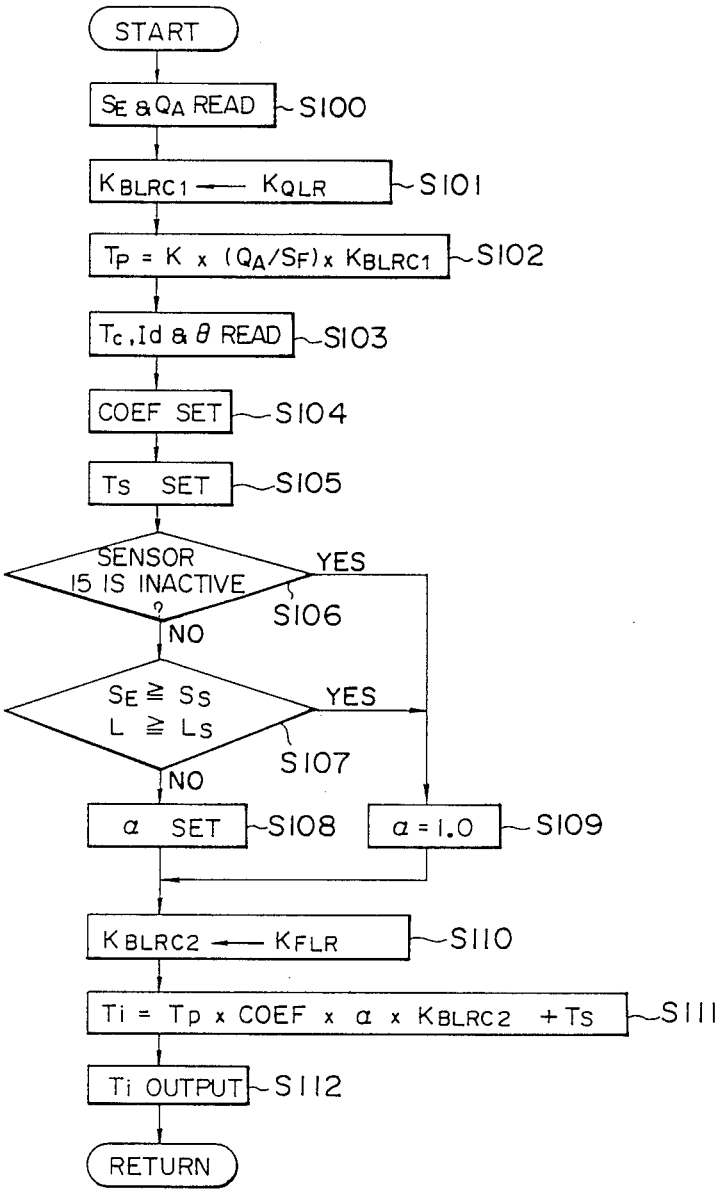
FIG. 4 is a flow chart showing a control procedure of the air-fuel ratio control system.

Operation from STEPs S103 to S109 is the same as that of the unit 20 as shown in FIG. 4, thereby omitting the duplicational explanation.

At STEP S110A, the measuring system learning correction coefficient $K_{BLRC1}$ is set by the interpolational calculation in dependency on the measuring system learning value $K_{QLR}$ derived from the learning table $T_{QLR}$ for the measuring system by using the intake air quantity $Q_A$ as a parameter.

At STEP S110B, the injection system learning correction coefficient $K_{BLRC2}$ is set by the interpolatiOnal calculation in dependency on the injection system learning value $K_{FLR}$ derived from the learning table $T_{FLR}$ for the injection system by using the basic fuel injection quantity $T_p$ as a parameter.

At STEP S111A, the actual fuel injection quantity $T_i$ is set in dependency on the basic fuel injection quantity $T_p$, the various coefficient COEF, the air-fuel ratio correction coefficient the learning correction coefficients $K_{BLRC1}$ and $K_{BLRC2}$ for the measuring system and the injection system, and the voltage correction coefficient $T_S$ according to the following equation (12):

$$T_i = T_p \times COEF \times \alpha \times K_{BLRC1} \times K_{BLRC2} + T_S \quad (12).$$

Then, at STEP S112, the setting circuit 41 outputs the driving pulse signal corresponding to the actual fuel injection signal $T_i$ through the driving circuit 42 to the injectors 8.

Figure 5:
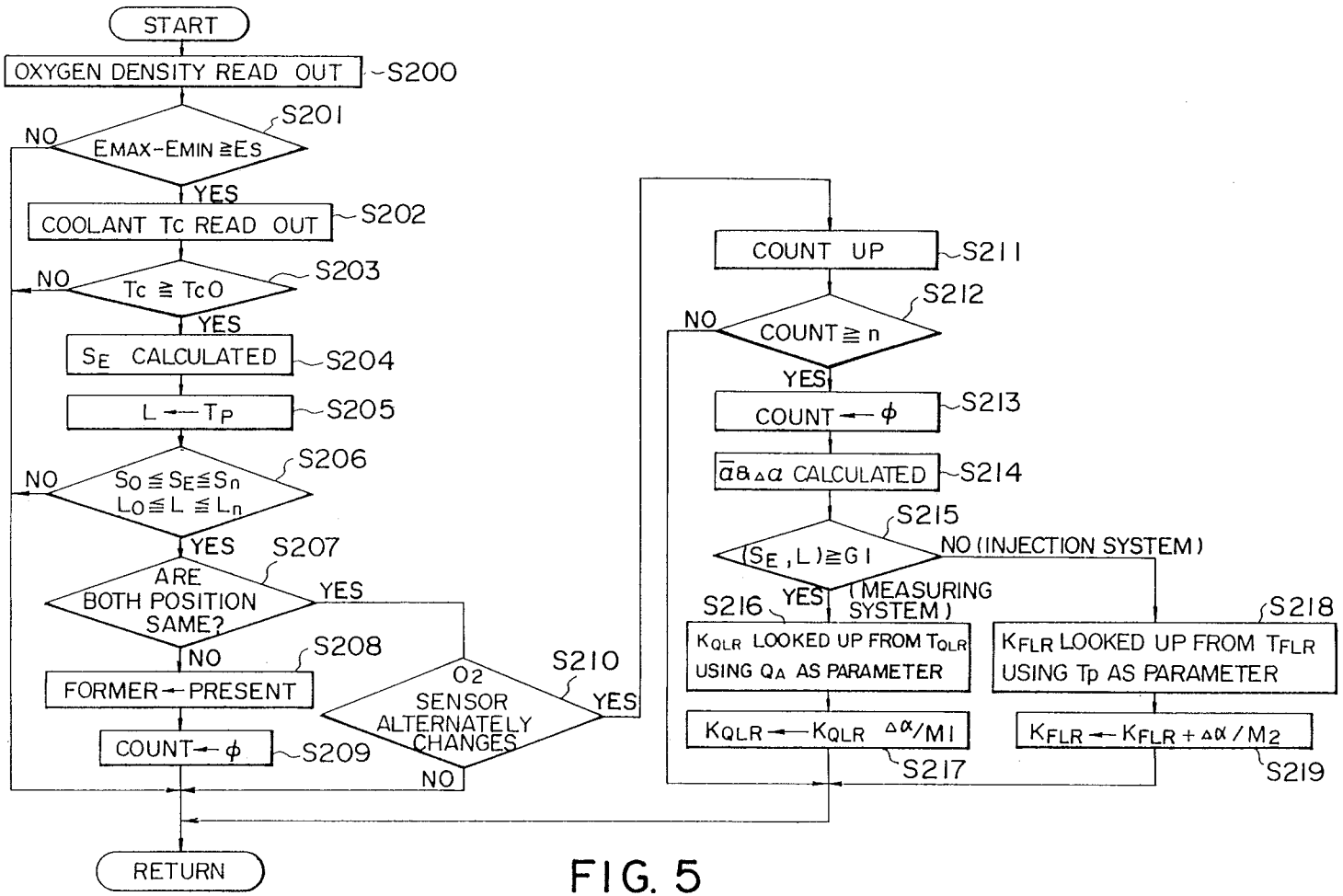
FIG. 5 is a flow chart showing a rewriting procedure of a learning value of the control system.

The learning value renewal procedure of the unit 20A according to the second embodiment is the same as that of the first embodiment represented by the flow charts shown in FIG. 5, except for the condition to select whether the learning of the injection system or of the measuring system. Namely, the system according to the second embodiment of the present invention performs the measuring system learning at the canister purge at least when the idling switch 12a is turned off, and when the coolant temperature $T_C$ is in condition "$T_C \geqq T_{C0}$", and the system performs the injection system learning at cutting off the canister purge, namely, when the switch 12a is turned on. Accordingly, the system of the second embodiment has a specific effect to prevent the air-fuel ratio changes when the canister purge and the purge cut are switched over each other by the correction using the learning correction coefficients $K_{BLRC1}$ and $K_{BLRC2}$ for the measuring system and the injection system at setting the actual fuel injection quantity $T_i$.

As aforementioned in detail, the air-fuel ratio control system according to the present invention, selects the learning region from the measuring system learning region and the injection system learning region corresponding to the engine operating condition. Accordingly, as the learning regions do not overlap between the fuel injection system and the measuring system and as both systems do not need to have the conflicting learning values in the same learning region, the present invention has the excellent effects that it is possible to improve the learning accuracy, the controllability, the reformation of the exhaust emission, and the fuel consumption.

Furthermore, when the system comprises the canister purge system, it is possible to prevent the change of the air-fuel ratio according to switching between the purge and the purge cut conditions and to improve the engine performance.

While the presently preferred embodiments of the present invention have been shown and described, it is to be understood that these disclosures are for the purpose of illustration and that various changes and modification may be made without departing from the scope of the invention as set forth in the appended claims.

We claim:

1. An air-fuel ratio control system for an automotive engine, having an engine speed sensor for detecting an engine speed, an air-fuel ratio sensor for detecting the condition of an air-fuel ratio of the engine, a fuel injection system with an injector for injecting fuel into a combustion chamber of said engine, and an intake air quantity measuring system including an intake air quantity sensor for detecting an intake air quantity; the control system comprising designation means for designating a learning region corresponding to an engine operating condition by selecting one of a first learning region for the measuring system and a second learning region for the injection system;

first learning means responsive to a selection of said first learning region by said designation means for learning a first correction quantity in said measuring system from a discrepancy amount between a reference air-fuel ratio and an actual air-fuel ratio calculated in dependency on a signal output from said air-fuel ratio sensor;

second learning means responsive to a selection of said second learning region by said designation means for learning a second correction quantity in said injection system from said discrepancy amount; and fuel injection quantity setting means for calculating a basic fuel injection quantity in dependency on said engine speed and for setting an actual fuel injection quantity with said first correction quantity learned by said first learning means and said second correction quantity learned by said second learning means.

2. The air-fuel ratio control system according to claim 1, wherein;

said first learning means includes a first table storing a plurality of said first correction quantities in dependency on said intake air quantity and said second learning means includes a second table storing a plurality of said second correction quantities in dependency on an engine load, so that one of said first correction quantities and one of said second correction quantities are picked up for setting said actual fuel injection quantity based on said intake air quantity and said engine load, respectively.

3. The air-fuel ratio control system according to claim 1, wherein;

said designation means includes a map indicating said first learning region and said second learning region in dependency on said engine speed and engine load for designating one of both regions.

4. The air-fuel ratio control system according to claim 1, further comprising;

a canister purge control system for adsorbing a vaporized fuel in a fuel tank and supplying the vaporized fuel to an intake port of said engine corresponding to a negative pressure of a vicinity of said throttle valve; and said designation means which designates a learning of said second learning means when said throttle valve is full closed, and designates a learning of said first learning means when the throttle valve is opened responsive to a signal output from said throttle position sensor.

5. The air-fuel ratio control system according to claim 1, further comprising;

feedback determining means for determining whether or not said air-fuel ratio feedback control is necessary in dependency on the active condition of said air-fuel ratio sensor and said engine speed; and feedback correction means for setting an air-fuel ratio feedback correction coefficient in dependency on a signal from said air-fuel ratio sensor when said feedback determining means determines to start said air-fuel ratio feedback control and for outputting a feedback correction coefficient signal to said first learning means, and second learning means, and said fuel injection quantity setting means.

* * * * *